US007901261B1

(12) United States Patent
Rosas Zarich et al.

(10) Patent No.: US 7,901,261 B1
(45) Date of Patent: Mar. 8, 2011

(54) BOARD ASSEMBLY FOR KITESURFING AND/OR KITEBOARDING

(75) Inventors: Jose Rosas Zarich, Paracas (PE); Matthew Philip Jones, El Cajon, CA (US)

(73) Assignee: Swivelboard LLC, El Cajon, CA (US)

( * ) Notice: Subject to any disclaimer, the term of this patent is extended or adjusted under 35 U.S.C. 154(b) by 46 days.

(21) Appl. No.: 12/421,832

(22) Filed: Apr. 10, 2009

Related U.S. Application Data

(60) Provisional application No. 61/124,209, filed on Apr. 15, 2008.

(51) Int. Cl.
*B63B 35/81* (2006.01)

(52) U.S. Cl. ..... 441/74; 280/14.22; 441/65

(58) Field of Classification Search ..... 441/65, 441/70, 74, 75; 280/14.21, 14.22, 14.24, 280/14.25, 14.26, 605, 606, 607, 617, 618
See application file for complete search history.

(56) References Cited

U.S. PATENT DOCUMENTS

| | | | | |
|---|---|---|---|---|
| 4,163,565 | A * | 8/1979 | Weber | 280/14.21 |
| 4,221,394 | A * | 9/1980 | Campbell | 280/14.25 |
| 5,021,017 | A | 6/1991 | Ott | |
| 5,499,837 | A | 3/1996 | Hale et al. | |
| 5,931,504 | A * | 8/1999 | Armitage | 280/14.21 |
| 6,203,051 | B1 | 3/2001 | Sabol | |
| 6,341,786 | B1 * | 1/2002 | Kermis | 280/14.22 |
| 6,773,021 | B2 * | 8/2004 | Breuer et al. | 280/14.21 |
| 6,817,619 | B2 * | 11/2004 | Harrison | 280/14.22 |
| 6,923,454 | B2 | 8/2005 | Drako | |
| 7,059,614 | B2 | 6/2006 | Cole, III | |
| 7,237,784 | B1 * | 7/2007 | Monteleone | 280/87.042 |

* cited by examiner

*Primary Examiner* — Lars A Olson
(74) *Attorney, Agent, or Firm* — Edward W. Callan

(57) ABSTRACT

A board assembly for kitesurfing and/or kiteboarding includes an elongated board for traversing a supporting surface while a person is riding the board and apparatus for changing the orientation of the person's feet relative to the different ends of the board. Such apparatus includes a deck that is rotatably attached to the board, foot receptacles coupled to the deck and a device for facilitating rotation of the deck between different stationary positions relative to the different ends of the board while the board is traversing the supporting surface. The device for facilitating rotation temporarily locks the deck in one of the stationary positions upon the deck having been rotated to the one of stationary positions. The device for facilitating rotation responds to motion of the person's feet by causing the deck to be released from retention in the stationary positions.

11 Claims, 9 Drawing Sheets

BOARD ASSEMBLY FOR KITESURFING AND/OR KITEBOARDING

BACKGROUND OF THE INVENTION

The present invention pertains to board assemblies for kitesurfing and/or kiteboarding. A board assembly for kitesurfing is mono-directional. A board assembly for kiteboarding is bi-directional. During both kitesurfing and kiteboarding, a kite is maneuvered by a person riding the board to propel the board across a supporting surface that is being traversed, such as water.

For kitesurfing the board assembly includes an elongated board with foot receptacles, such as straps, socks and/or bindings. A kiteboard includes a composite, wooden, or foam board. Kiteboards come in various shapes and sizes to suit the rider's skill level, riding style, and wind and water conditions.

The foot receptacles are disposed in relation to the ends of the board so that both feet of a person riding the board can face in the general direction of the kite from the person riding the board. Many kiteboards typically include sandal-type foot straps that allow a person to attach and detach from the board easily.

A person riding the board steers the board by using his/her legs to point one end of the board in a desired direction and to apply more force against the other end of the board so that the one end of the board rises above the supporting surface that is being traversed to facilitate movement of the board in the desired direction.

Kitesurfing boards typically are contoured to define a bow and a stern and include a prominent skeg or a fin, whereby the board moves more readily in the direction in which the bow is pointed. Also, the foot receptacles of kitesurfing boards preferably are disposed in relation to the ends of the board so that one foot receptacle is disposed closer to the stern than the other foot receptacle is disposed toward the bow, so that the difference in the amount of force applied by the legs need not be as large as otherwise would be required in order to maintain the bow above the watery surface.

When a kitesurfing board rider desires to reverse the general direction in which the board is moving, he/she maneuvers the kite to stall movement of the board, then reverses the respective disposition of one's feet in the foot receptacles to thereby change the orientation of one's feet relative to the bow and stern of the board, and then maneuvers the kite to once again propel the board.

SUMMARY OF THE INVENTION

The present invention provides a board assembly for kitesurfing and/or kiteboarding, comprising: an elongated board for traversing a supporting surface while a person is riding the board; and apparatus for changing the orientation of the person's feet relative to the different ends of the board, the apparatus including: a deck rotatably attached to the board; foot receptacles coupled to the deck for simultaneously disposing both of the person's feet in generally the same direction; and means for facilitating rotation of the deck between different stationary positions relative to the different ends of the board; wherein the means for facilitating rotation facilitate said rotation in response to motion of the person's feet are within the receptacles and while the board is traversing the supporting surface; and wherein the means for facilitating rotation temporarily lock the deck in one of said stationary positions upon the deck having been rotated to said one of the stationary positions from another of the stationary positions.

The present invention also provides a method of changing the orientation of one's feet relative to the different ends of an elongated board while one is riding the board and the board is traversing a supporting surface, the method comprising the steps of:

(a) standing on a deck that is rotatably attached to the board with one's feet being simultaneously disposed in generally the same direction by foot receptacles attached to the deck; and (b) while one's feet are within the receptacles, moving one's feet to cause the deck to rotate between different stationary positions relative to the different ends of the board and thereby change the orientation of one's feet relative to the different ends of the board;

wherein the deck is temporarily locked in one of said stationary positions upon having been rotated to said one stationary position from another of said stationary positions; and wherein step (b) comprises the step of:

(c) moving one's feet in at least one particular motion to cause the deck to be released from said retention in the one of the stationary positions for rotation to another of the stationary positions.

The present invention further provides apparatus for changing the orientation of a person's feet relative to the different ends of a board that is used for traversing a supporting surface while the person is riding the board, the apparatus including: a deck for rotatable attachment to the board; foot receptacles attached to the deck for simultaneously disposing both of the person's feet in generally the same direction; and means for facilitating rotation of the deck between different stationary positions relative to the different ends of the board; wherein the means for facilitating rotation facilitate said rotation in response to motion of the person's feet while the person's feet are within the receptacles and while the board is traversing the supporting surface; and wherein the means for facilitating rotation temporarily lock the deck in one of said stationary positions upon the deck having been rotated to said one stationary position from another of said stationary positions.

Other board activities to which the present invention is applicable include wakeboarding, snow boarding and an activity in which a kite is used to propel a board rider across snow.

Additional features of the present invention are described with reference to the detailed description.

DETAILED DESCRIPTION

Figure 1:
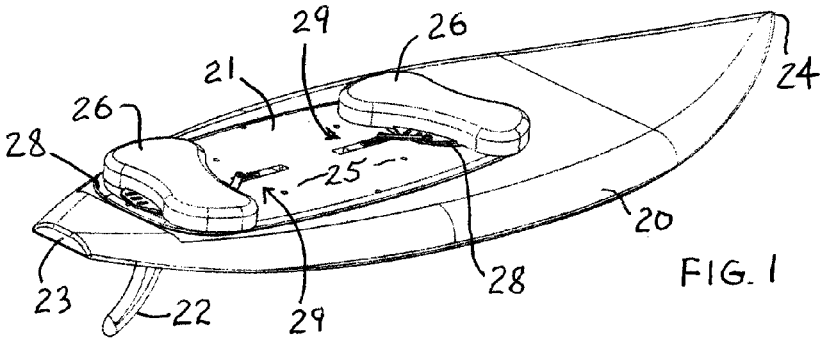
FIG. 1 is a perspective view of one embodiment of a kitesurfing board assembly according to the present invention.

Referring to FIGS. 1, 2, 3, 4, 5, 6 and 7, one embodiment of a kitesurfing board assembly according to the present invention includes an elongated board 20 and a deck 21. The elongated board 20 is adapted for traversing a watery surface while a person is riding the board 20. A fin 22 is attached to the underside of board 20 near the stern 23 of the board 20. In an alternative embodiment (not shown), the stern has a prominent skeg instead of a fin.

The deck 21 is rotatably attached to the board 20 so that the deck 21 can be rotated between different stationary positions relative to the stern 23 and the bow 24 of the board 20 while a person is riding the board 20 and the board 20 is traversing a watery surface. The axis of rotation 35 is normal to the lateral and longitudinal axes of the board 20. A plurality of bearing assemblies 25 supports the deck 21 on the board 20 for rotation of the deck 21 with respect to the board 20.

Foot receptacles 26 are coupled to the deck 21 for simultaneously disposing both of a person's feet in generally the same direction. In various alternative embodiments, the foot receptacles 26 include straps, bindings, shoes and/or socks. The foot receptacles 26 are coupled to the deck 21 by platforms 28 that are separately rotatable relative to the deck 21.

Apparatus for changing the orientation of a person's feet relative to the different ends 23, 24 of the board 20 while the person is riding the board 20 and the board 20 is traversing a watery surface include the deck 21, the foot receptacles 26, the platforms 28 and two devices 29 extending toward the center of the deck from the respective platforms 28 for facilitating rotation of the deck 21 between different stationary positions relative to the stern 23 and the bow 24 of the board. The devices 29 for facilitating such rotation of the deck 21 facilitate such rotation in response to motion of the person's feet while the person's feet are within the receptacles 26 and while the board 21 is traversing the watery surface.

Figure 2:
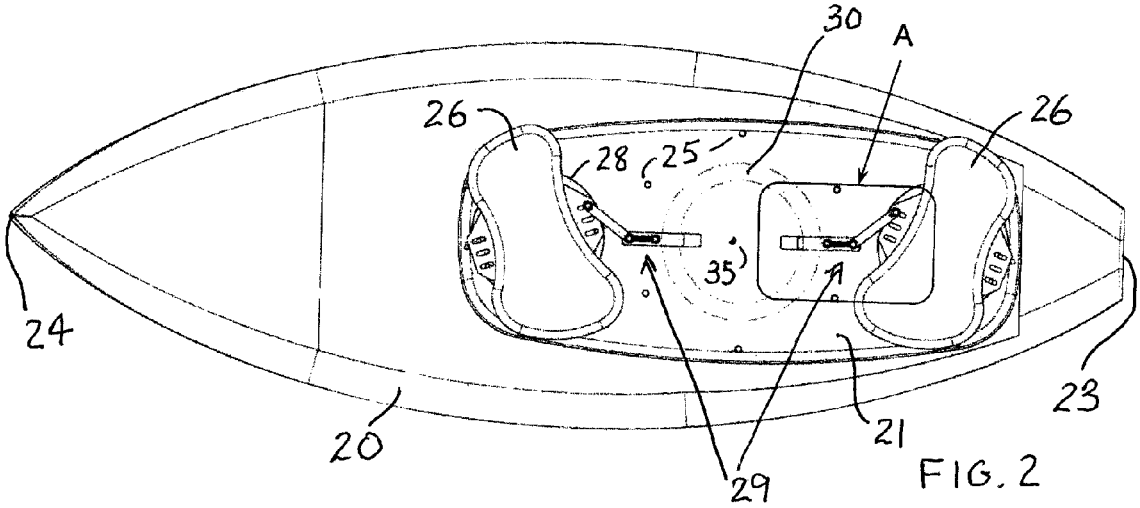
FIG. 2 is a top view of the board assembly shown in FIG. 1.
Figure 3:
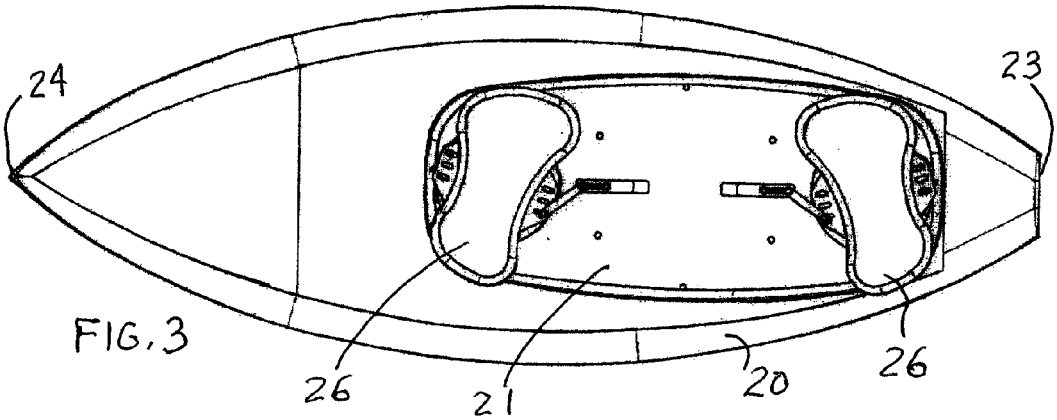
FIG. 3 is a top view of the board assembly shown in FIG. 1, with the deck rotated to a different position than shown in FIGS. 1 and 2.

The devices 29 for facilitating rotation of the deck 21 temporarily lock the deck 21 in one of first and second stationary positions upon the deck 21 having been rotated to one of the first and second stationary positions, as shown in FIG. 2, from the other of the first and second stationary positions, as shown in FIG. 3. The devices 29 for facilitating rotation of the deck 21 respond to at least one particular motion of the person's feet by causing the deck 21 to be released from retention in one of the first and second stationary positions for rotation to the other of the first and second stationary positions.

Referring to FIGS. 4, 5, 6 and 7, one embodiment of a device 29 for facilitating rotation of the deck 21 includes a locking ring 30 that is common to both of the devices 29, and a locking bolt 31, a link 32 and a compression spring 33 that are separately provided in each device 29. The locking ring 30 is made of plastic and each locking bolt 31 is made of carbon graphite. The locking ring 30 is non-rotatably secured to the board 20 and is centered at the axis of rotation 35 of the deck 21.

The locking bolt 31 is disposed in a recess 37 in the deck 21. The locking bolt 31 is secured to the deck 21 by a deck bolt 38. There are retaining slots 40 in the inner edge of the locking ring 30 adjacent the distal ends of the locking bolts 31.

One end of the link 32 is rotatably coupled to the platform 28 by a first link bolt 42 and the other end of the link 32 is rotatably coupled to the locking bolt 31 by a second link bolt 43.

The compression spring 33 is disposed in a channel 45 within the locking bolt 31 between the deck bolt 38 at one end of the channel 45 and an interior edge of the locking bolt 31 at the other end of the channel 45.

Figure 5:
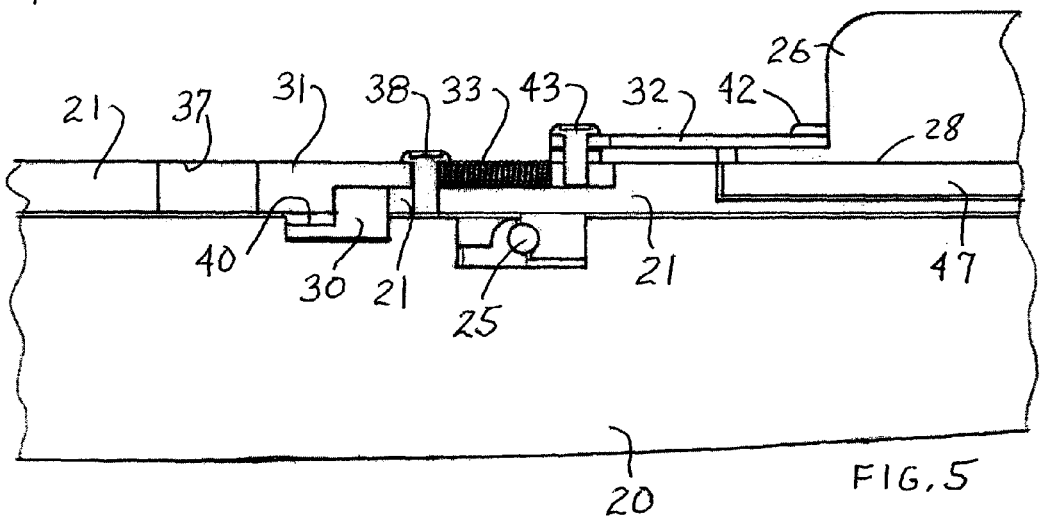
FIG. 5 is a sectional view taken along line 5-5 of the partially cutaway view shown in FIG. 4.
Figure 7:
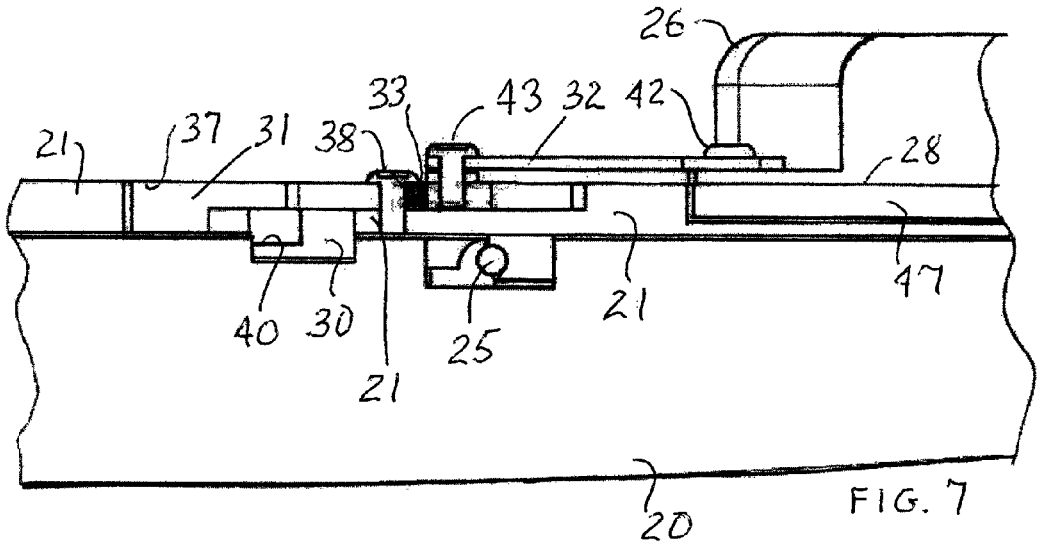
FIG. 7 is a sectional view taken along line 7-7 of the partially cutaway view shown in FIG. 6.
Figure 8:
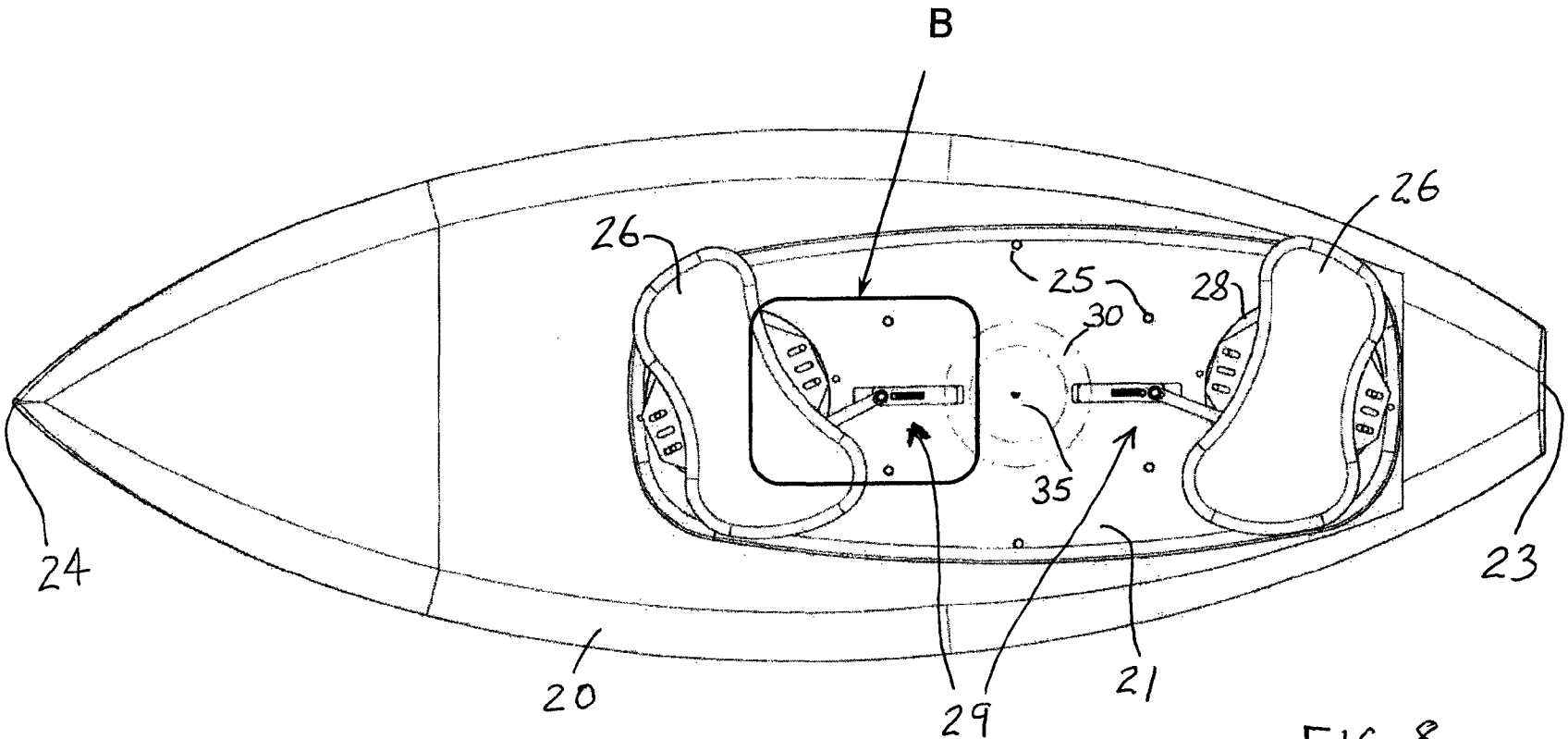
FIG. 8 is a top view of another embodiment of a kitesurfing board assembly according to the present invention.

FIGS. 5 and 7 show one of the bearing assemblies 25 as being disposed between the deck 21 and the board 20. A portion of the platform 26 containing a bearing is shown at 47.

Figure 4:
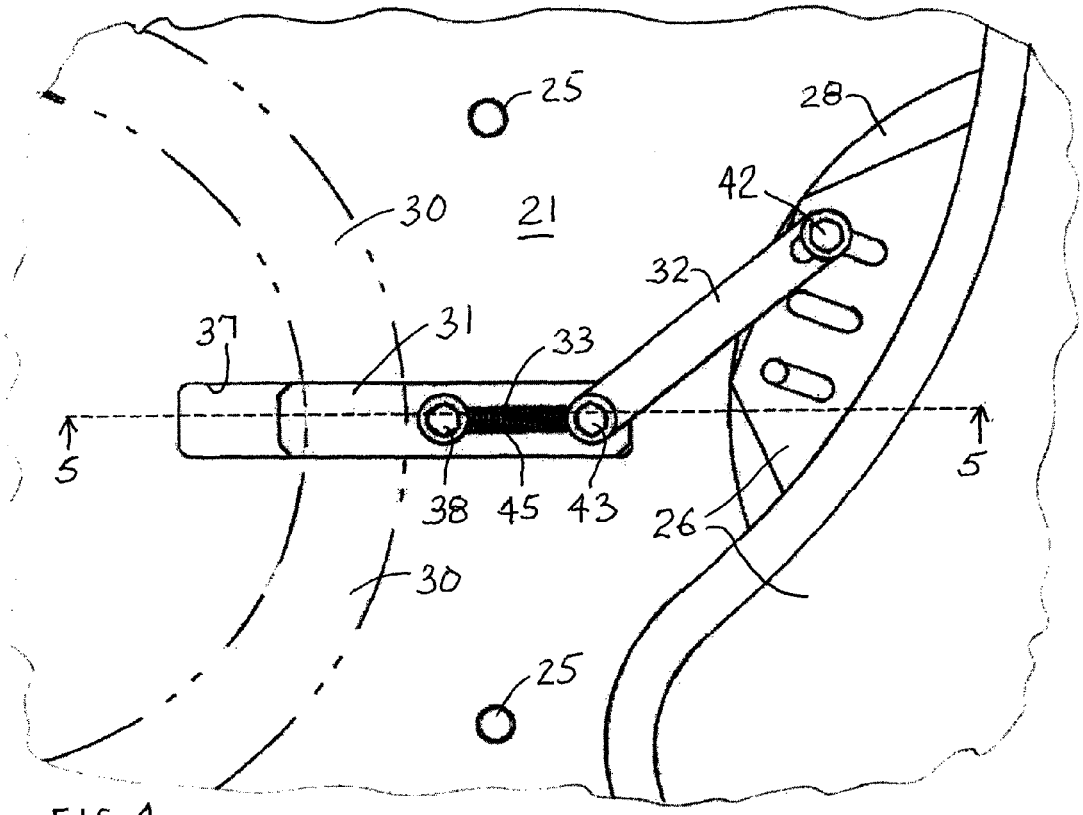
FIG. 4 is an enlarged top partially cutaway view of one embodiment of a portion A of the board assembly shown in FIG. 2, with the deck in a locked position.
Figure 6:
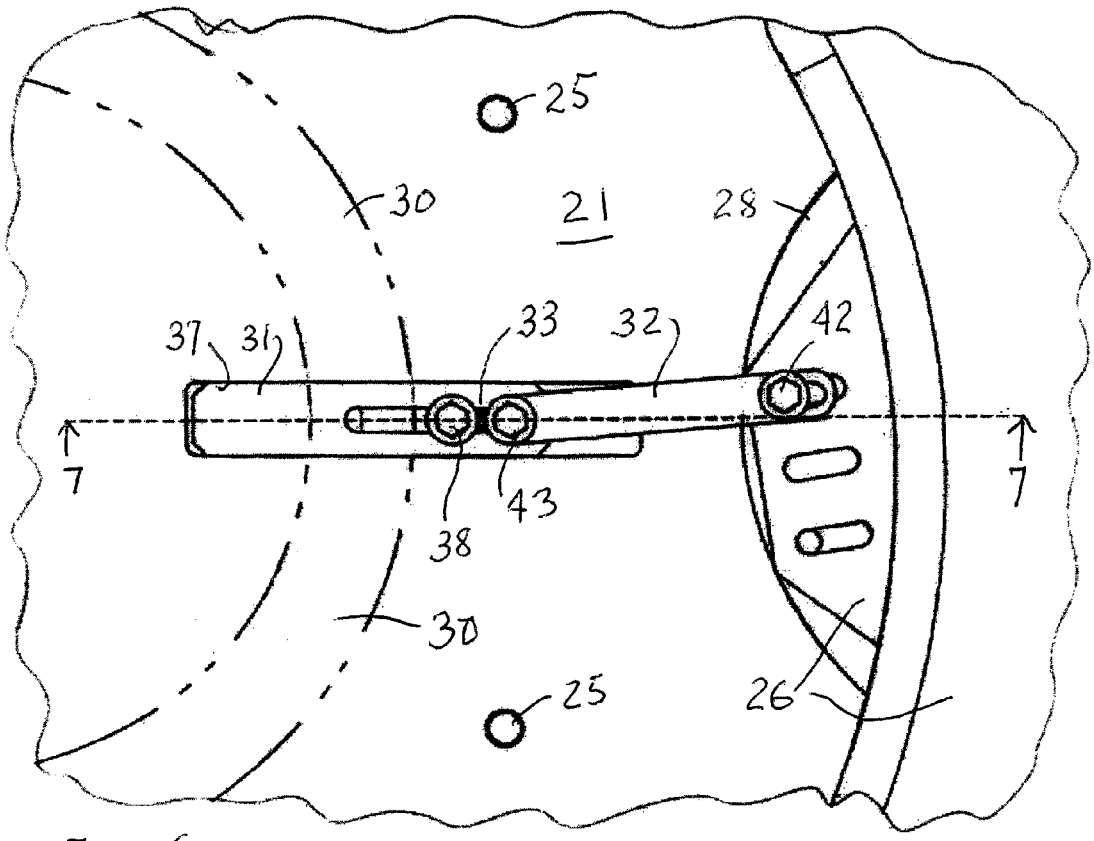
FIG. 6 is an enlarged top partially cutaway view of the embodiment of the portion A of the board assembly shown in FIG. 2, with the deck in an unlocked position.

As shown in FIGS. 4 and 5 the deck 21 is temporarily retained in a locked position when the distal end of the locking bolt 31 is retained within a slot 40 in the inner edge of the locking ring 30. In order to cause the deck 21 to be released from the locked position shown in FIGS. 4 and 5, the person riding the board 20 rotates his feet inward to cause the platforms 26 to rotate in such a manner as to cause the links 32 to compress the compression springs 33 and thereby push the locking bolts 31 out of the slots 40 in the inner edge of the locking ring 30, as shown in FIGS. 6 and 7. The rider can then use his legs to cause the deck 21 to rotate in a desired clockwise or counter-clockwise direction from one of the first and second stationary positions to the other of the first and second stationary positions.

An alternative embodiment includes only one of the devices 29 for facilitating rotation of the deck 21. However, two such devices 29 are preferred.

Referring to FIGS. 8, 9, 10, 11 and 12, another embodiment of a kitesurfing board assembly according to the present invention is generally the same as the embodiment shown in FIGS. 1, 2, 3, 4, 5, 6 and 7, except that there are retaining slots 49 in the outer edge of the locking ring 30 adjacent the distal ends of the locking bolts 31, and the locking bolt 31 is secured to the deck 21 by a deck pin 50, with the compression spring 33 being disposed in the channel 45 within the locking bolt 31 between the deck pin 50 at one end of the channel 45 and an interior edge of the locking bolt 31 at the other end of the channel 45.

Figure 9:
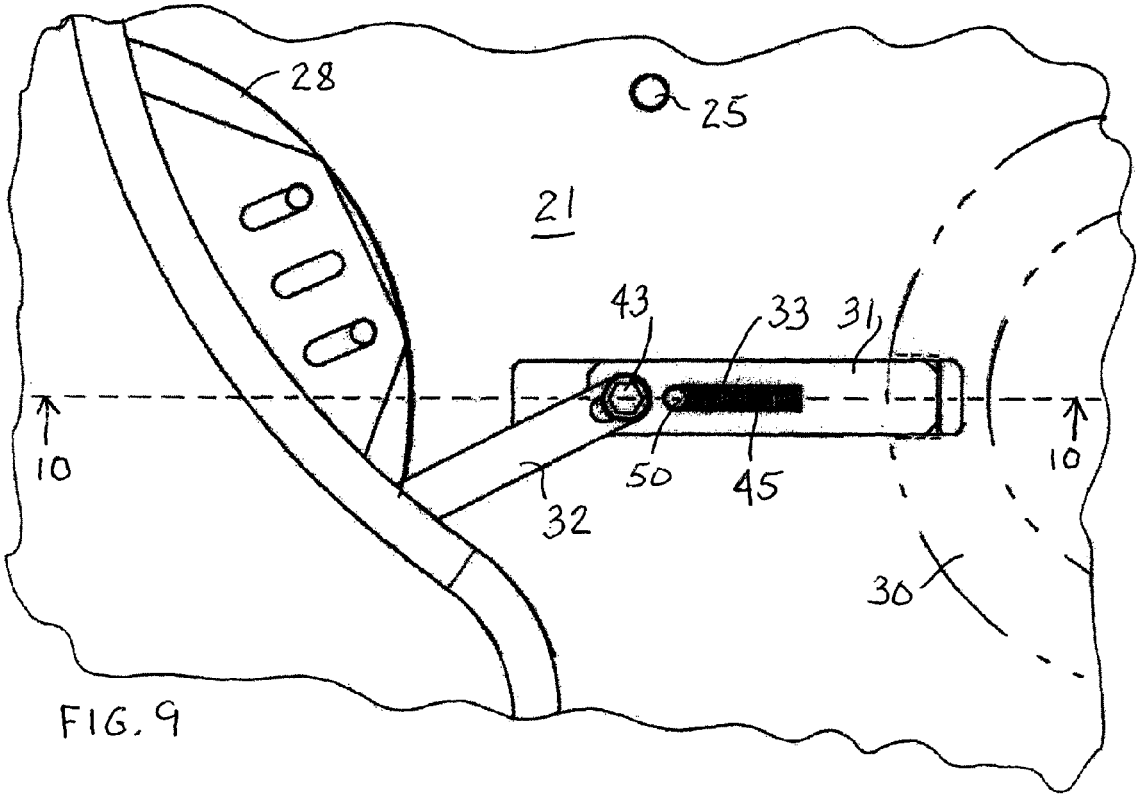
FIG. 9 is an enlarged top partially cutaway view of a portion B of the board assembly shown in FIG. 8, with the deck in a locked position.
Figure 10:
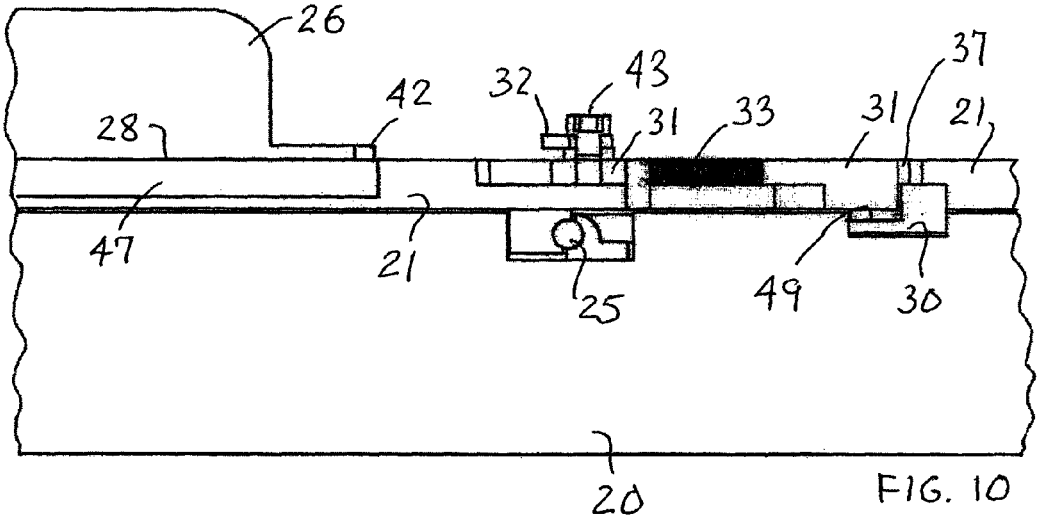
FIG. 10 is a sectional view taken along line 10-10 of the partially cutaway view shown in FIG. 9.
Figure 11:
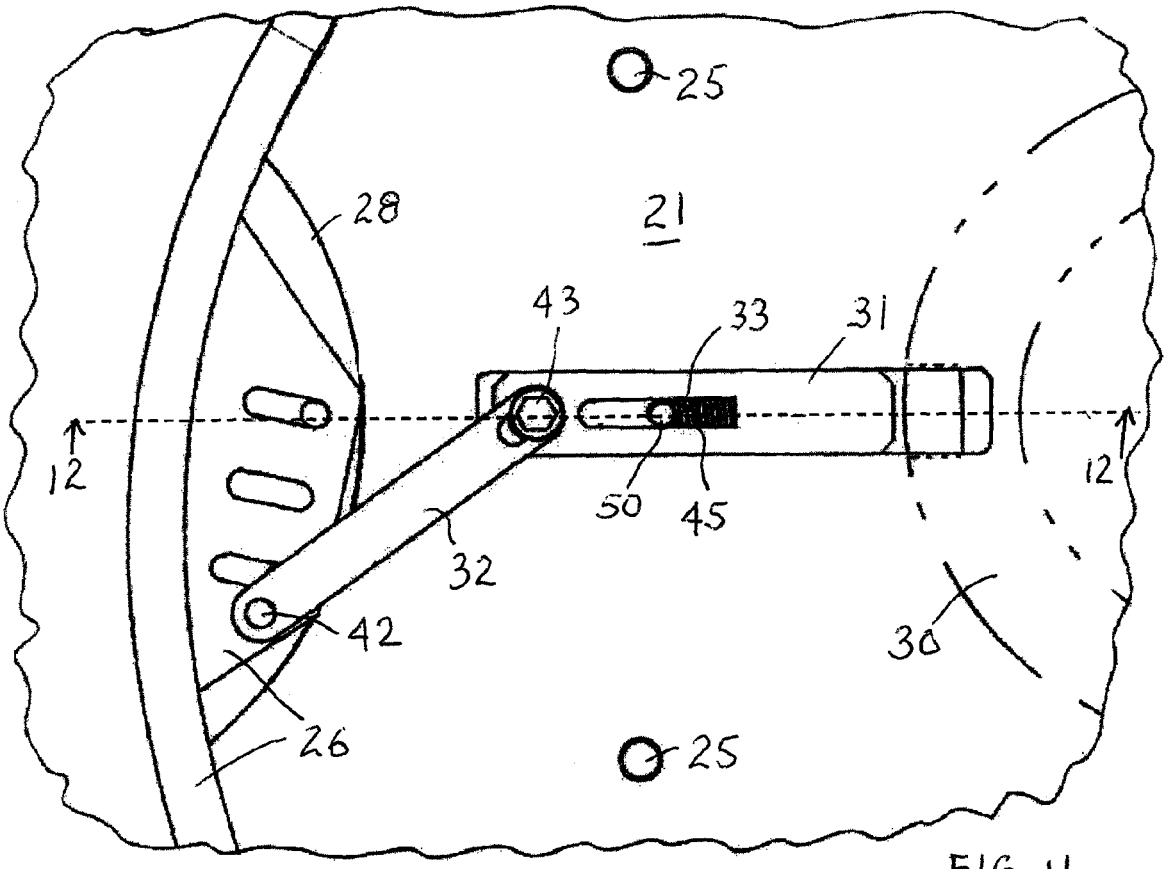
FIG. 11 is an enlarged top partially cutaway view of the embodiment of the portion B of the board assembly shown in FIG. 8, with the deck in an unlocked position.
Figure 12:
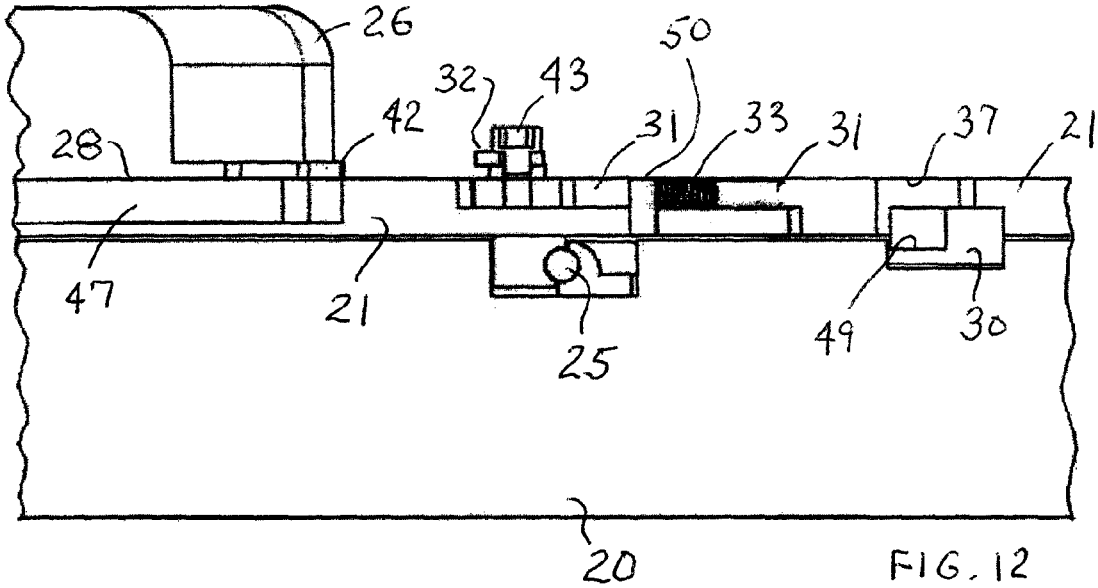
FIG. 12 is a sectional view taken along line 12-12 of the partially cutaway view shown in FIG. 11.
Figure 13:
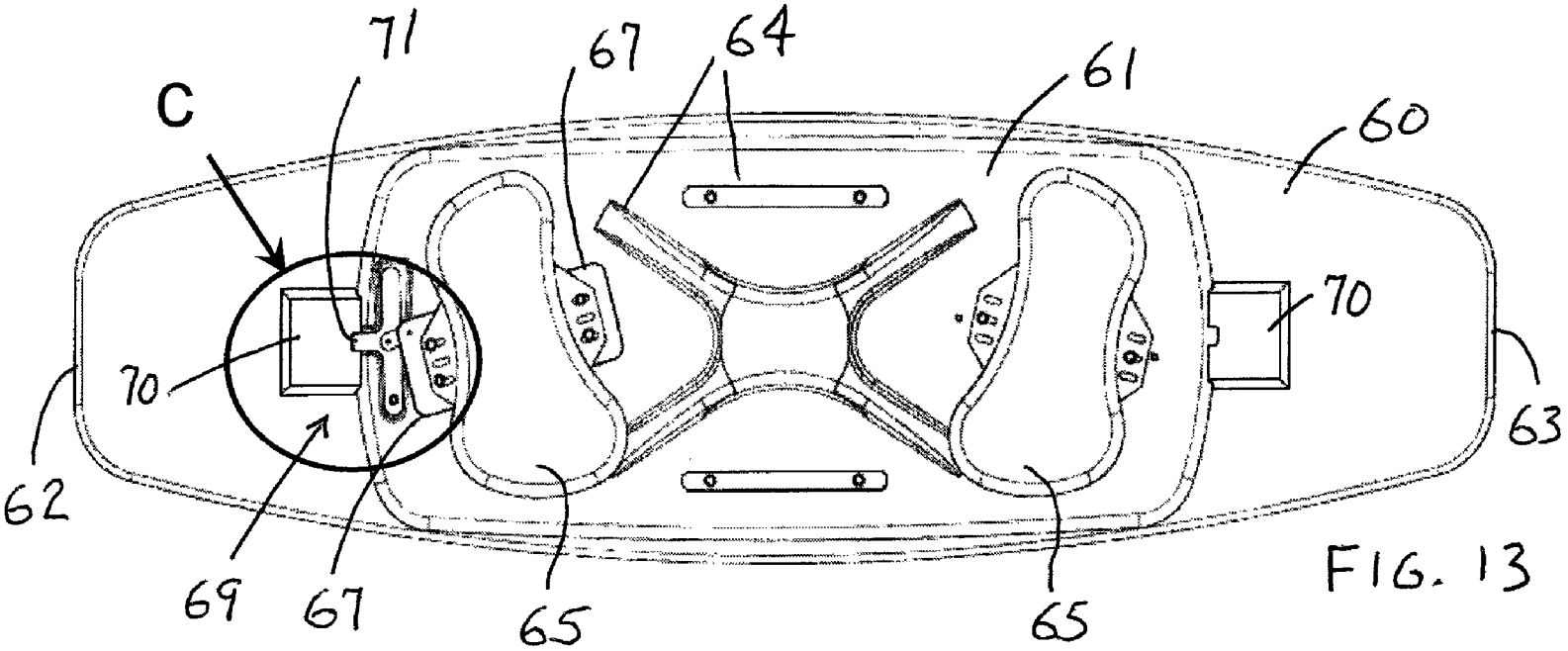
FIG. 13 is a top view of an embodiment of a kiteboard assembly according to the present invention.
Figure 14:
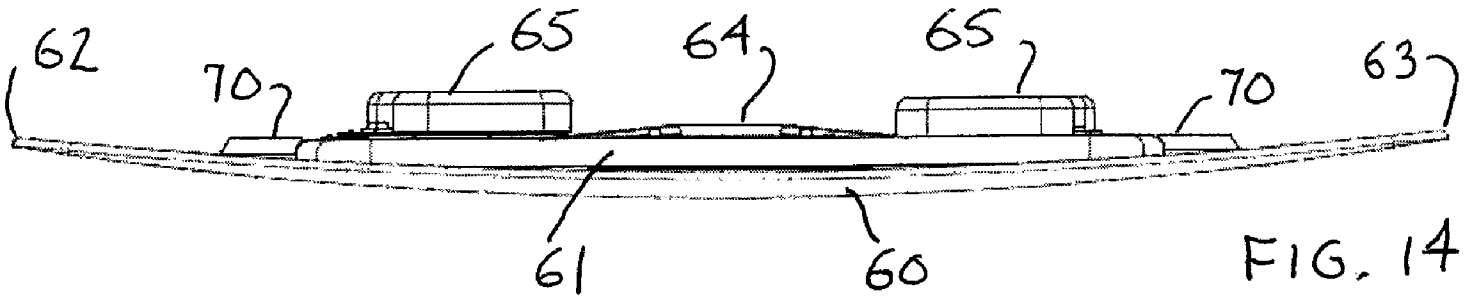
FIG. 14 is a side view of the embodiment of the board shown in FIG. 13.

As shown in FIGS. 9 and 10 the deck 21 is temporarily retained in a locked position when the distal end of the locking bolt 31 is retained within a slot 49 in the outer edge of the locking ring 30. In order to cause the deck 21 to be released from the locked position shown in FIGS. 9 and 10, the person riding the board 20 rotates his feet inward to cause the platforms 26 to rotate in such a manner as to cause the links 32 to compress the compression springs 33 and thereby pull the locking bolts 31 out of the slots 40 in the outer edge of the locking ring 30, as shown in FIGS. 11 and 12.

Referring to FIGS. 13, 14, 15, 16, 17 and 18, an embodiment of a kiteboard assembly according to the present invention includes an elongated board 60 and a deck 61. The elongated board 60 is adapted for traversing a supporting surface, such as water or snow, while a person is riding the board 60.

The deck 61 is rotatably attached to the board 60 so that the deck 61 can be rotated between different stationary positions relative to different ends 62, 63 of the board 60 while a person is riding the board 60 and the board 60 is traversing the supporting surface. The deck 61 includes structural support members 64. A plurality of bearing assemblies (not shown) supports the deck 61 on the board 60 for rotation of the deck 61 with respect to the board 60.

Foot receptacles 65 are coupled to the deck 61 for simultaneously disposing both of a person's feet in generally the same direction. In various alternative embodiments, the foot receptacles 65 include straps, bindings, shoes and/or socks. The foot receptacles 65 are coupled to the deck 61 by platforms 67 that are separately rotatable relative to the deck 61.

Apparatus for changing the orientation of a person's feet relative to the different ends 62, 63 of the board 60 while the person is riding the board 60 and the board 60 is traversing the supporting surface include the deck 61, the foot receptacles 65, the platforms 67 and a device 69 for facilitating rotation of the deck 61 between different stationary positions relative to the different ends 62, 63 of the board. The device 69 for facilitating such rotation of the deck 61 facilitates such rotation in response to motion of the person's feet while the person's feet are within the receptacles 65 and while the board 60 is traversing the supporting surface.

The device 69 for facilitating rotation of the deck 61 temporarily locks the deck 61 in one of first and second stationary positions upon the deck 61 having been rotated to the one of the first and second stationary positions from the other of the first and second stationary positions. The device 69 for facilitating rotation of the deck 61 responds to at least one particular motion of the person's feet by causing the deck 61 to be released from retention in one of the first and second stationary positions for rotation to the other of the first and second stationary positions.

Figure 15:
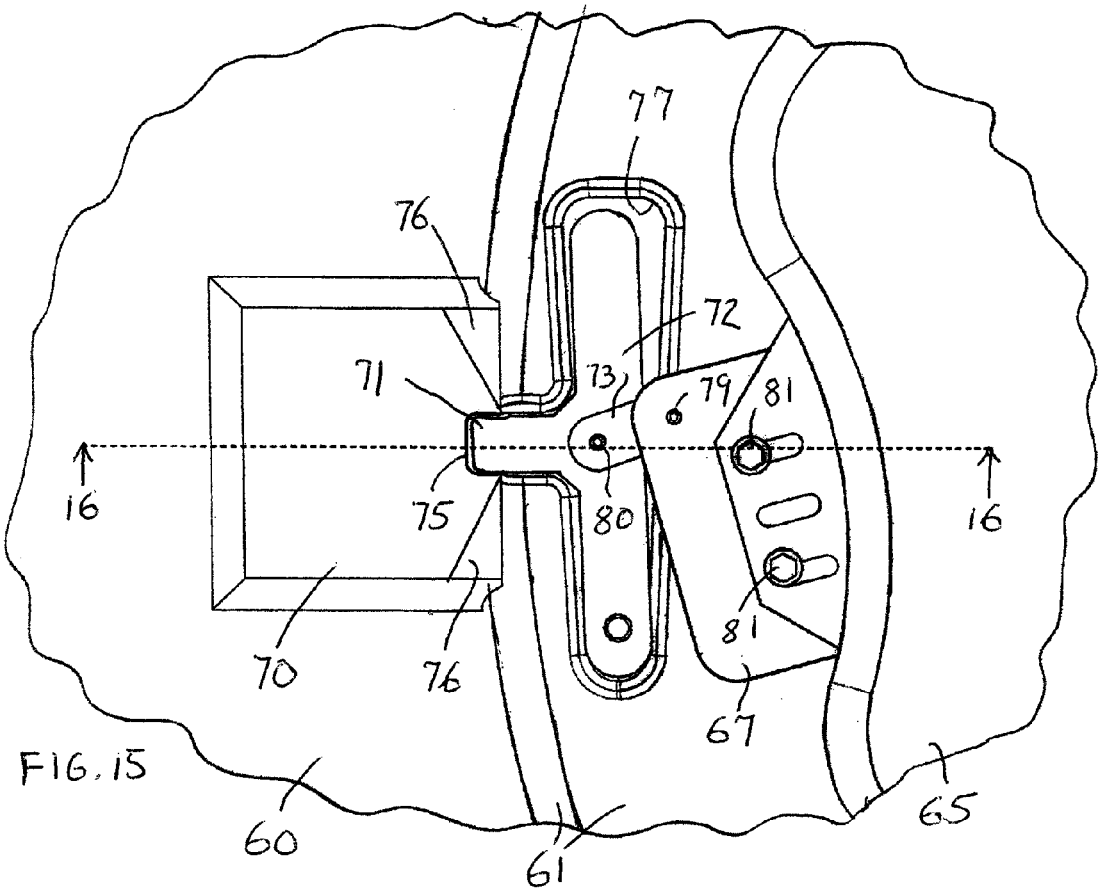
FIG. 15 is an enlarged top partially cutaway view of a portion C of the board assembly shown in FIG. 13.
Figure 16:
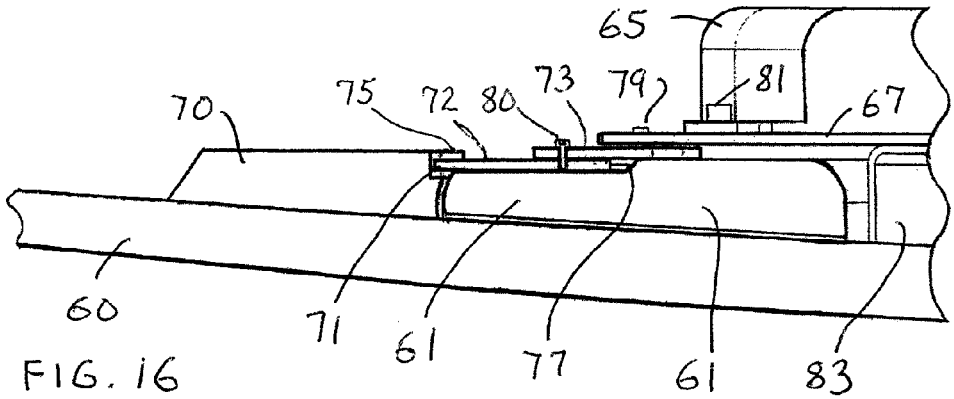
FIG. 16 is a sectional view taken along line 16-16 of the partially cutaway view shown in FIG. 15.

Referring to FIGS. 15 and 16, one embodiment of the device 69 for facilitating rotation of the deck 61 includes a pair of locking blocks 70 that are secured to the board 60 at locations that are adjacent the respective opposite ends of the deck 61 when the deck 61 is in a stationary position, and a combination of a locking bolt 71 extending from one side of a locking cam 72 and a link 73, which is coupled to one of the platforms 67. The locking block 70 is made of plastic and the locking bolt 71 is made of carbon graphite. Each locking block 70 includes a slot 75 and ramps 76 that extend upward to the lateral edges of the slot 75 from the opposing edges of the locking block 70.

The locking cam 72 is disposed for movement within a recess 77 in the deck 61. One end of the link 73 is rotatably coupled to the platform 67 by a first link pin 79 and the other end of the link 73 is rotatably coupled to the locking cam 72 by a second link bolt pin 80.

One of the foot receptacles 65 is fastened to the platform 67 by a pair of bolts 81. The platform 67 is mounted on the deck 61 by a bearing 83.

Figure 17:
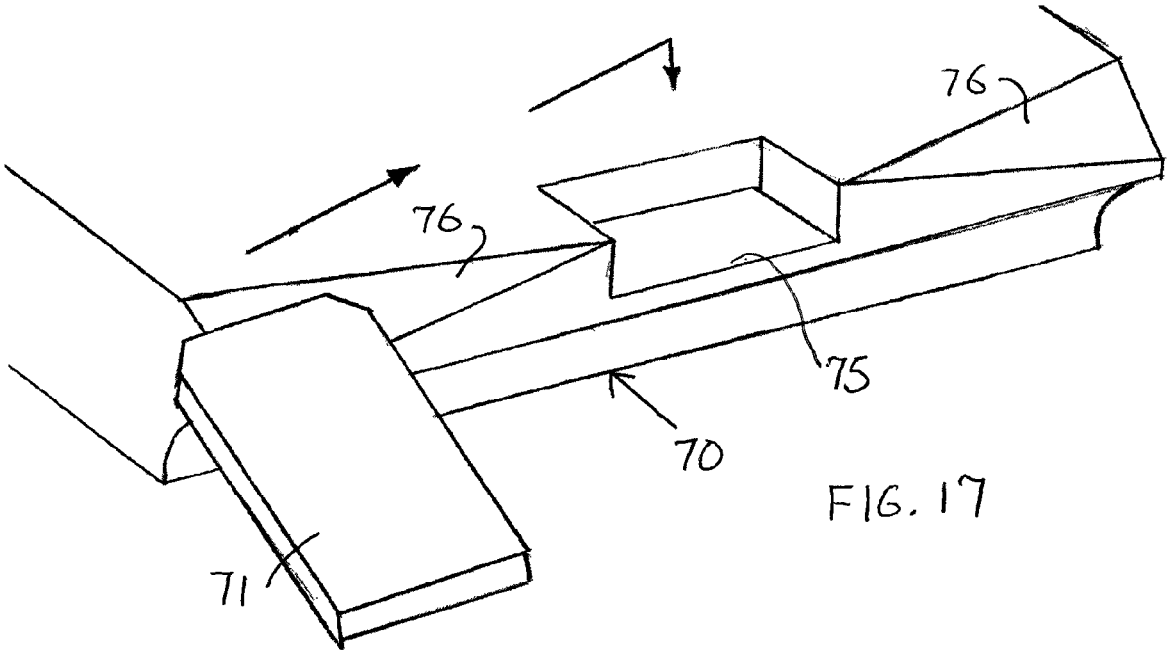
FIG. 17 is a perspective view illustrating operation of a portion of the board assembly shown in FIGS. 13, 15 and 16.
Figure 18:
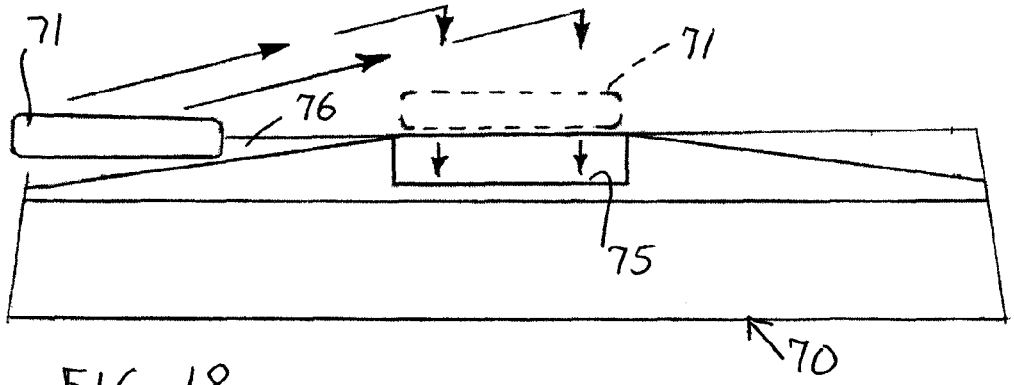
FIG. 18 is an end view illustrating operation of a portion of the board assembly shown in FIGS. 13, 15 and 16.

Referring to FIGS. 17 and 18, while the deck 61 is being rotated to one of the stationary positions, when the locking bolt 61 reaches one of the ramps 76 on the locking block 70, the locking bolt 71 climbs the ramp 76; and upon reaching a position over the slot 75 in the locking block 70, flexure of the locking cam 72 causes the locking bolt 71 to fall into the slot 75 in order to temporarily retain the deck 61 in a locked position.

In order to cause the deck 61 to be released from the locked position, the person riding the board 60 rotates his feet inward to cause the platforms 67 to rotate in such a manner as to cause the locking bolt 71 to be pulled out of the slots 75 so that the rider can then use his legs to cause the deck 61 to rotate in a desired clockwise or counter-clockwise direction from one of the first and second stationary positions to the other of the first and second stationary positions.

An alternative embodiment includes two of the devices 69 for facilitating rotation of the deck 61; wherein a combination of the locking bolt 71 extending from one side of the locking cam 72 and the link 73 is coupled to each of the platforms 67.

In other alternative embodiments one or two of the devices 29 for facilitating rotation of the deck can be used in a kiteboard and one or two of the devices 69 for facilitating rotation of the deck can be used in kitesurfing board.

The benefits specifically stated herein do not necessarily apply to every conceivable embodiment of the present invention. Further, such stated benefits of the present invention are only examples and should not be construed as the only benefits of the present invention.

While the above description contains many specificities, these specificities are not to be construed as limitations on the scope of the present invention, but rather as examples of the preferred embodiments described herein. Other variations are possible and the scope of the present invention should be determined not by the embodiments described herein but rather by the claims and their legal equivalents.

The invention claimed is:

1. A board assembly for kitesurfing and/or kiteboarding, comprising:

an elongated board for traversing a supporting surface while a person is riding the board; and apparatus for changing the orientation of the person's feet relative to the different ends of the board, the apparatus including:

a deck rotatably attached to the board;

foot receptacles coupled to the deck for simultaneously disposing both of the person's feet in generally the same direction; and means for facilitating rotation of the deck between different stationary positions relative to the different ends of the board;

wherein the means for facilitating rotation facilitate said rotation in response to motion of the person's feet while the person's feet are within the receptacles and while the board is traversing the supporting surface; and wherein the means for facilitating rotation temporarily lock the deck in one of said stationary positions upon the deck having been rotated to said one of the stationary positions from another of the stationary positions.

2. A board assembly according to claim 1, wherein the means for facilitating rotation respond to at least one particular motion of the person's feet by causing the deck to be released from said retention in the one of the stationary positions for rotation to another of the stationary positions.

3. A board assembly according to claim 1, wherein the means for facilitating rotation of the deck include platforms to which the foot receptacles are attached, with the platforms being separately rotatable relative to the deck in response to a particular rotary movement of the person's feet for causing the deck to be released from said retention in the one of the stationary positions relative to the different ends of the board for rotation to the other of the stationary positions.

4. A board assembly according to claim 1, wherein the elongated board has a bow at one end of the board and a stern at the other end of the board; and wherein the deck is attached to the board for rotation about an axis that is located closer to the stem than to the bow.

5. A board assembly according to claim 1, wherein the deck is attached to the board for rotation about an axis that is normal to the lateral and longitudinal axes of the board.

6. A method of changing the orientation of one's feet relative to the different ends of an elongated board while one is riding the board and the board is traversing a supporting surface, the method comprising the steps of:

(a) standing on a deck that is rotatably attached to board with one's feet being simultaneously disposed in generally the same direction by foot receptacles attached to the deck; and (b) while one's feet are within the receptacles, moving one's to cause the deck to rotate between different stationary positions relative to the different ends of the board and thereby change the orientation of one's feet relative to the different ends of the board;

wherein the deck is temporarily locked in one of said stationary positions upon having been rotated to said one stationary position from another of said stationary positions; and wherein step (b) comprises the step of:

(c) moving one's feet in at least one particular motion to cause the deck to be released from said retention in the one of the stationary positions for rotation to another of the stationary positions.

7. A method according to claim 6, wherein the deck is attached to the board for rotation about an axis that is normal to the lateral and longitudinal axes of the board.

8. Apparatus for changing the orientation of a person's feet relative to the different ends of a board that is used for traversing the supporting surface while the person is riding the board, the apparatus including:

a deck for rotatable attachment to the board;

foot receptacles attached to the deck for simultaneously disposing both of the person's feet in generally the same direction; and means for facilitating rotation of the deck between different stationary positions relative to the different ends of the board;

wherein the means for facilitating rotation facilitate said rotation in response to motion of the person's feet while the person's feet are within the receptacles and while the board is traversing the supporting surface; and wherein the means for facilitating rotation temporarily lock the deck in one of said stationary positions upon the deck having been rotated to said one stationary position from another of said stationary positions.

9. Apparatus according to claim 8, wherein the means for facilitating rotation respond to at least one particular motion of the person's feet by causing the deck to be released from said retention in one of said stationary positions for rotation to another of said stationary positions.

10. Apparatus according to claim 8, wherein the means for facilitating rotation of the deck include platforms to which the foot receptacles are attached, with the platforms being separately rotatable relative to the deck in response to a particular rotary movement of the person's feet for causing the deck to be released from said retention in one of said stationary positions relative to the different ends of the board for rotation to another of said stationary positions.

11. Apparatus according to claim 8, wherein the deck is adapted for rotation about an axis that is normal to the lateral and longitudinal axes of the board.

* * * * *

UNITED STATES PATENT AND TRADEMARK OFFICE

CERTIFICATE OF CORRECTION

PATENT NO. : 7,901,261 B1
APPLICATION NO. : 12/421832
DATED : March 8, 2011
INVENTOR(S) : Jose Rosas Zarich et al.

It is certified that error appears in the above-identified patent and that said Letters Patent is hereby corrected as shown below:

at column 1, line 62, after "feet" insert --while the person's feet--
at column 7, line 10, before "board" insert --the--

Signed and Sealed this
Twenty-seventh Day of September, 2011

David J. Kappos

David J. Kappos
*Director of the United States Patent and Trademark Office*